US012638226B2

(12) United States Patent
Gindele et al.

(10) Patent No.: US 12,638,226 B2
(45) Date of Patent: May 26, 2026

(54) DEVICE FOR MIST GENERATION IN A REFRIGERATING AND/OR FREEZING APPLIANCE

(71) Applicant: LIEBHERR-HAUSGERAETE OCHSENHAUSEN GMBH, Ochsenhausen (DE)

(72) Inventors: Thomas Gindele, Leutkirch (DE); Arnulf Probst, Altenstadt (DE); Rene Baumann, Illerberg (DE); Lucio Alende Reffatti, Senden (DE)

(73) Assignee: LIEBHERR-HAUSGERAETE OCHSENHAUSEN GMBH, Ochsenhausen (DE)

( * ) Notice: Subject to any disclaimer, the term of this patent is extended or adjusted under 35 U.S.C. 154(b) by 377 days.

(21) Appl. No.: 18/247,730

(22) PCT Filed: Oct. 27, 2021

(86) PCT No.: PCT/EP2021/079892
§ 371 (c)(1),
(2) Date: Apr. 3, 2023

(87) PCT Pub. No.: WO2022/090347
PCT Pub. Date: May 5, 2022

(65) Prior Publication Data

US 2023/0417471 A1 Dec. 28, 2023

(30) Foreign Application Priority Data

Oct. 29, 2020 (DE) ..... 10 2020 128 516.7
May 11, 2021 (DE) ..... 10 2021 112 317.8

(51) Int. Cl.
*F25D 17/04* (2006.01)
*F25D 25/02* (2006.01)

(52) U.S. Cl.
CPC ..... *F25D 17/042* (2013.01); *F25D 25/02* (2013.01); *F25D 2317/0413* (2013.01)

(58) Field of Classification Search
CPC ..... F25D 17/042; F25D 25/02; F25D 2317/0413
USPC ..... 261/81, DIG. 48
See application file for complete search history.

(56) References Cited

U.S. PATENT DOCUMENTS

2011/0232321 A1 9/2011 Bortoletto et al.

FOREIGN PATENT DOCUMENTS

| | | | |
|---|---|---|---|
| CN | 106016558 | A | 10/2016 |
| CN | 106152670 | A | 11/2016 |
| CN | 107062744 | A | 8/2017 |
| DE | 102013213206 | A1 | 1/2015 |

(Continued)

OTHER PUBLICATIONS

English Machine Translation of KR 100651276 B1 (Year: 2006).*

(Continued)

*Primary Examiner* — Charles S Bushey
(74) *Attorney, Agent, or Firm* — McCoy Russell LLP

(57) ABSTRACT

The invention relates to a device for mist generation in a refrigerating and/or freezing appliance, including a refrigerator shelf for receiving items to be cooled in the refrigerator, a piezo unit which is arranged in the shelf and, separate therefrom, a water tank for mist generation which is operatively connected to the piezo unit and is also arranged in the shelf and preferably can be removed from the shelf.

14 Claims, 5 Drawing Sheets

(56) References Cited

FOREIGN PATENT DOCUMENTS

| | | | | |
|---|---|---|---|---|
| DE | 102014017044 | A1 | | 5/2015 |
| DE | 102016204381 | A1 | * | 9/2017 |
| DE | 102016009345 | A1 | | 10/2017 |
| EP | 2368446 | A1 | | 9/2011 |
| EP | 3228964 | A1 | | 10/2017 |
| JP | 2006118825 | A | | 5/2006 |
| KR | 20000001443 | U | * | 1/2000 |
| KR | 100651276 | B1 | * | 11/2006 |

OTHER PUBLICATIONS

English Machine Translation of KR 20000001443 U (Year: 2000).*
English Machine Translation of DE 102016204381 A1 (Year: 2017).*
ISA European Patent Office, International Search Report Issued in Application No. PCT/EP2021/079892, Feb. 8, 2022, WIPO, 5 pages.
China National Intellectual Property Administration, Office Action and Search Report Issued in Application No. 202180073770.7, Mar. 14, 2025, 18 pages.

* cited by examiner

DEVICE FOR MIST GENERATION IN A REFRIGERATING AND/OR FREEZING APPLIANCE

CROSS REFERENCE TO RELATED APPLICATIONS

The present application is a U.S. National Phase of International Application No. PCT/EP2021/079892 entitled "DEVICE FOR MIST GENERATION IN A REFRIGERATING AND/OR FREEZING APPLIANCE," and filed on Oct. 27, 2021. International Application No. PCT/EP2021/079892 claims priority to German Patent Application No. 10 2020 128 516.7 filed on Oct. 29, 2020, and to German Patent Application No. 10 2021 112 317.8 filed on May 11, 2021. The entire contents of each of the above-listed applications are hereby incorporated by reference for all purposes.

TECHNICAL FIELD

The invention relates to a device for mist generation in a refrigerator unit and/or a freezer unit.

BACKGROUND AND SUMMARY

It is of advantage for certain goods to be stored in a refrigerator if said goods are exposed to increased humidity during their storage. This can extend their state of freshness and results in an improved taste experience when consuming the goods. It is in particular of advantage for certain fruit and vegetable types if the humidity during storage is particularly high.

It is known from the prior art to use a mist generator in the refrigerated inner space of a refrigerator unit or freezer unit that forms mist from a water reservoir with the aid of a piezoelectric element. Reference is made in this connection by way of example to DE 10 2014 017 044 A1 that discloses such a unit.

It is disadvantageous in the implementation known in the prior art for the generation of mist in a refrigerator that a plurality of components are necessary for this purpose that result in an increased complexity of the refrigerator. A plurality of water lines are thus often necessary to supply the required amount of water to the device for mist generation. The generation of mist, that is increased humidity, is namely typically desired in the lower region of a refrigerator since the temperature is the lowest there and fruit and vegetables are stored in a drawer there as a rule.

It is the aim of the present invention to provide mist generation in a refrigerator unit and/or a freezer unit and to take up as little space as possible and to install as few components as possible in so doing.

This is done using a device for mist generation in a refrigerator unit and/or a freezer unit.

Provision is made in accordance with the invention that the device for mist generation in a refrigerator unit and/or a freezer unit comprises a compartment base of a refrigerator for placing goods to be refrigerated in the refrigerator, a piezo unit that is arranged in the compartment base, and a water tank for mist generation that is separate therefrom, that is operatively connected to the piezo unit, that is likewise arranged in the compartment base, and the can preferably be removed from the compartment base.

No water lines that continuously supply the required amount of water are necessary due to the provision of the piezo unit and the water tank separate therefrom in the compartment base. A refrigerator equipped with a device in accordance with the invention therefore has reduced complexity. In addition, the available cooling volume is only minimally reduced by the arrangement of the piezo unit and the water tank in a compartment base for a refrigerator.

The compartment base can thus, for example, be arranged with the water tank generating the mist directly above a drawer fillable with fruit and vegetables to discharge the mist directly into the drawer disposed thereunder.

If the water tank is configured as removable from the compartment base, the user can fill the water tank with a corresponding amount of water as required. It is only necessary to access the corresponding compartment base and to remove the water tank for this purpose. After a refilling with water, the water tank is to be reinserted so that the device for mist generation can again work as normal.

Provision can be made in accordance with a further development of the invention that the water tank has a mist outlet to discharge mist at the lower side of the compartment base.

This is of advantage since then the upper side of the compartment base can be used completely normally as a storage surface for goods to be refrigerated and is not reduced in size by openings or the like. The introduction of mist from above is also of advantage for the compartment (or drawer) arranged thereunder and to be acted on by mist since the stored goods can thereby be ideally supplied with the increased humidity. The water mist falls down on its own due to the gravity that is present and is thus ideally distributed over the goods introduced to the compartment or in the drawer.

Provision can furthermore be made in accordance with the invention that the water tank has a cover that is inwardly shaped such that it separates a vapor generation chamber from a water reservoir chamber.

The cover can, for example, have an inwardly projecting wall at its inner side for this purpose that produces different chambers in the water tank.

Provision can additionally be made that the different chambers of the water tank are configured to have or to provide a different filling level or a different filling height of water so that there is always a sufficient level of a water filling level for an ideal mist generation in the vapor generation chamber.

Provision can furthermore be made that the vapor generation chamber is couplable to a piezoelectric element of the piezo unit via a recess in the outer contour of the water tank to generate mist (or water vapor) in the water tank with the aid of the sound waves emitted by the piezoelectric element.

Since the piezo unit is configured separately from the water tank and since a piezoelectric element is located therein, the sound waves emitted by the piezo unit are introduced into the interior of the water tank via the recess or via an opening thereof. The introduced sound waves there have the effect that mist is generated from the water located in the water tank.

Provision can be made in accordance with a further development of the invention that the cover has an inwardly projecting drip edge in the transition region of the vapor generation chamber to prevent water collecting and/or condensing at the cover in the vapor generation chamber from moving along the cover and drips down in the region of the mist outlet. Provision can additionally be made in accordance with the invention that the mist outlet is an opening arranged opposite the cover in the base region of the water tank.

The drip edge can be an inwardly protruding elevated portion that prevents water located at the inner side of the cover at the cover from spreading beyond a certain region and dropping in drop from the cover in a region of the mist outlet.

Since the mist outlet is provided at the lower side of the water tank, the dropping of a drip from the cover in the region of the mist outlet would have the consequence under certain circumstances that the water drop falls through the mist outlet and falls into the compartment actually to be acted on by mist. However, since this is unwanted, the drip edge that is provided at the cover and that prevents the migrating of water located at the inner cover side into the region of the mist outlet is of advantage. The drip edge is arranged here such that the water drops collect thereat and drop from there into the vapor generation chamber and/or into the water reservoir chamber.

Provision can be made in accordance with an advantageous modification of the invention that the water tank comprises a concentrate that reflects the sound waves or water jets emanating from the piezoelectric element, preferably like a lens focuses on a point or a region of a cover of the water tank from where the water or the mist is guided in the direction of the mist outlet.

Provision can furthermore be made that in accordance with the invention that the water tank terminates with the compartment base in an inserted state such that the compartment base and the water tank form a common approximately planar surface. The compartment base, like the upper side of the water tank, can be used to place down goods to be refrigerated due to the formation of a common approximately planar surface with the inserted water tank.

Provision can be made in accordance with an optional modification of the present invention that the piezo unit has a piezoelectric element and the sound waves generated by the piezoelectric element produce a generation of mist in the water tank inserted in the compartment base.

Provision can be made here that the piezoelectric element projects from the front face of the piezo unit such that it can dip into a corresponding recess of the water tank to generate mist there.

Provision can additionally be made in accordance with an advantageous variant of the invention that the piezo unit further comprises all the electronic components that are required to generate the mist. The electrical control of a piezoelectric element can thus be arranged, preferably encapsulated, in the piezo unit to be protected as much as possible from influences from the outside.

In accordance with an optional modification of the invention, the piezo unit can furthermore also be provided with a mechanism for raising the water tank that works mechanically or with motor assistance.

The water tank can also be removed simply by the provision of a mechanism for raising the water tank.

Provision can be made here that the piezo unit for raising the water tank has at least one lever device that can be actuated via a pressing or sliding mechanism accessible at the surface of the compartment base, with the lever device preferably being provided with at least one spring element.

The raising of the water tank from its introduced position cooperating with the piezo unit can accordingly be effected via the pressing and/or sliding mechanism. The raised water tank is then no longer aligned with the compartment base in a planar manner, but rather protrudes from the compartment base plane so that a user can easily remove the water tank.

Once the raising device has been actuated, spring elements can provide that the water tank remains in the raised position on its own. To reinsert the refilled water tank, the user then has to press the water tank in against the spring force until said water tank latches in its position cooperating with the piezo unit.

Provision can be made in accordance with a further development of the invention that the water tank is expelled upwardly with by exertion of a compressive force spring assistance so that it can be easily removed. To reinsert it, the water tank can then again be pressed in against the spring force such that it is then again in its intended position.

Provision can be made in accordance with a further optional modification of the present invention that the compartment base is not firmly connected to a carcass of the refrigerator, but can rather be pushed into the refrigerator at any desired position.

It is advantageous here that the region of a refrigerator that can be acted on by mist is variably selectable and can be designed individually in accordance with the needs of every user.

Provision can furthermore be made in accordance with the invention that the compartment base is arranged directly above a refrigerator drawer or a refrigerator compartment to introduce mist to increase the humidity into the drawer or into the compartment.

The arrangement of the compartment base directly above a drawer is particularly advantageous since the goods arranged in the drawer are very effectively exposed to the high humidity generated by the mist or water vapor.

Provision can be made in accordance with a further optional modification of the present invention that the water tank and the piezo unit are arranged in the front half, preferably in the front third, of the compartment base.

A simple access to the water tank is thereby also ensured when goods to be refrigerated are already located on the compartment base. The compartment base can also be used in its typical appearance in the rear part not taken up by the device; for example, a glass base insert can be used. The uniform overall impression of a plurality of different compartment bases is thereby strengthened even though at least one of them is provided with the device in accordance with the invention.

The arrangement of the water tank and the piezo unit in the front half, or in the front third, is also furthermore advantageous to this extent since the user can visually perceive the production of the mist that flows into a drawer arranged thereunder. An advantageous impression is thereby produced in the user of the performance of a refrigerator unit and/or a freezer unit provided with the device in accordance with the invention.

Provision can additionally be made that the water tank is not only used for the generation of mist, but that further consumers of a refrigerator also make use of it. An icemaker, a water output point, and/or a beverage system, or the like can, for example, all access the water in the water tank.

BRIEF DESCRIPTION OF THE FIGURES

Further advantages, features, and details of the present invention will become clear on the basis of the description of the Figures. There are shown.

DETAILED DESCRIPTION

Figure 1:
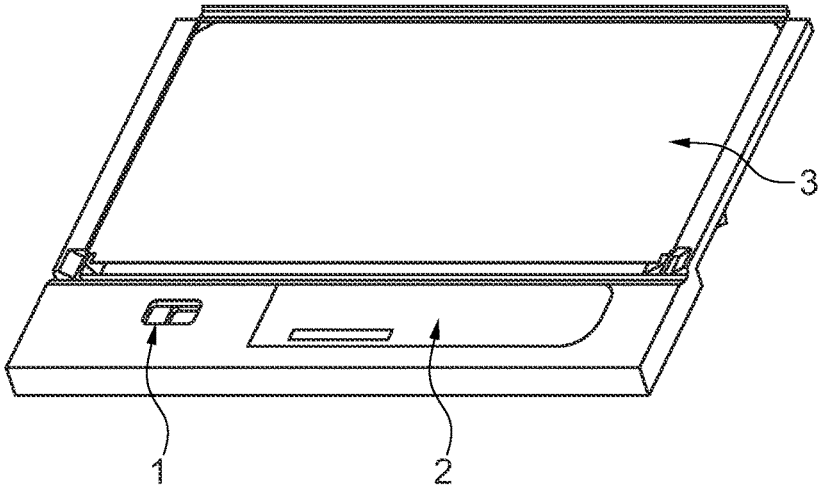
FIG. 1: a perspective representation of s device in accordance with the invention.

FIG. 1 shows a perspective representation of a device in accordance with the invention; A compartment base 3 of a refrigerator unit and/or a freezer unit can be recognized that is equipped with a piezo unit (not recognizable in FIG. 1) and an associated water tank 2. The water tank 2 can be raised out of its position flush with the compartment base via a pressing and/or sliding mechanism 1 to be able to remove it and refill it with water in a simple manner.

Figure 2:
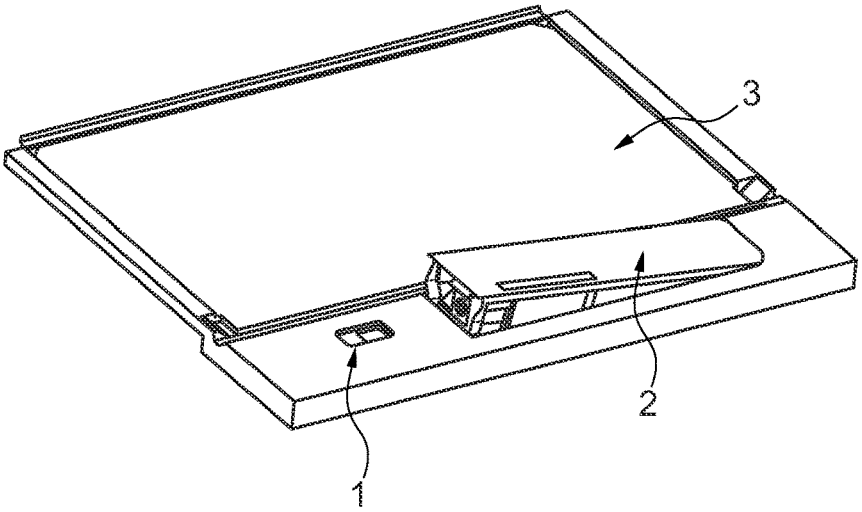
FIGS. 2-3: two different perspective representations of a device in accordance with the invention with a water tank in the ejected state.
Figure 3:
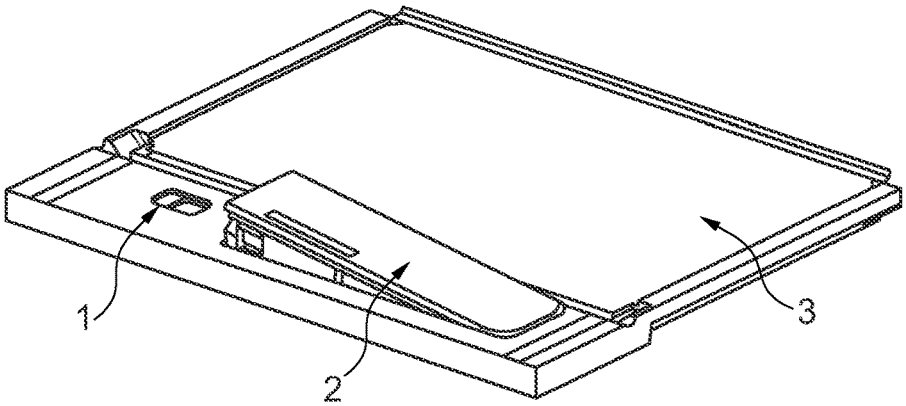

FIGS. 2 and 3 show two different perspective representations of the device with a water tank 2 in the ejected state; The part of the water tank 2 that faces the piezo unit 7 arranged below the pressing and/or sliding mechanism 1 is here raised upward from the plane of the compartment base.

It is a positive secondary effect here that the filling opening of the water tank is thus at a higher level so that a partially full water tank can also be moved into the raised position without water escaping from it.

Figure 4:
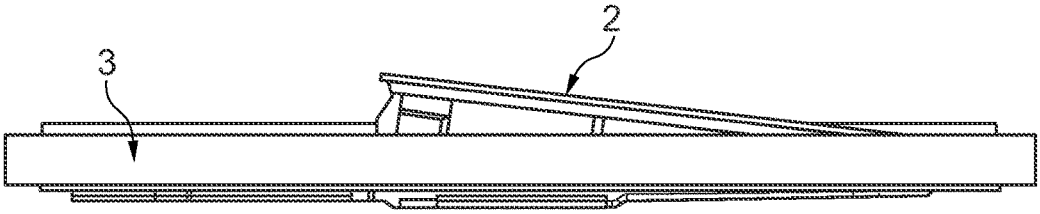
FIGS. 4-5: a side representation and a side sectional representation of a device in accordance with the invention with a water tank in the ejected state.
Figure 5:
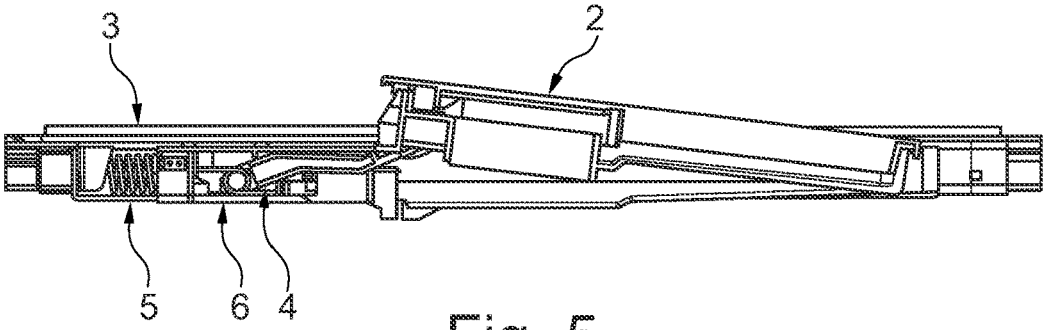
Figure 6:
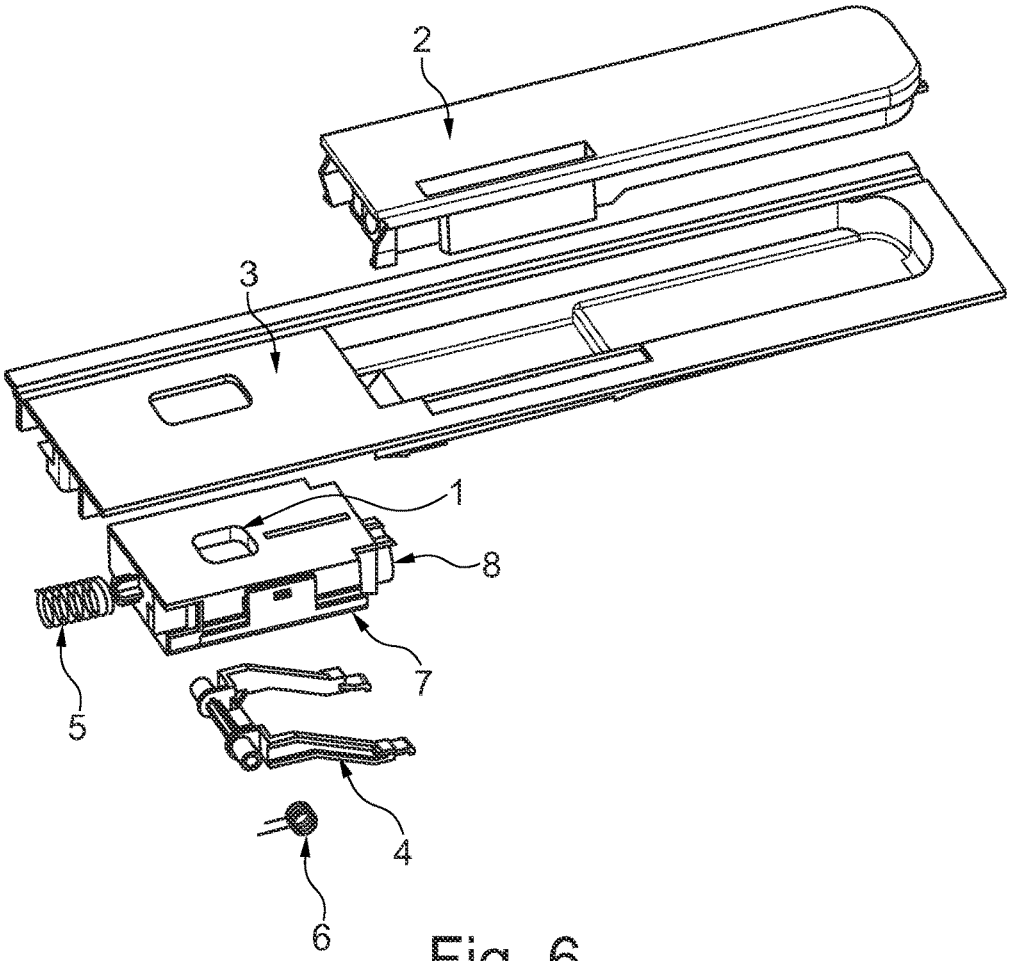
FIG. 6: an exploded representation of the device in accordance with the invention.
Figure 7:
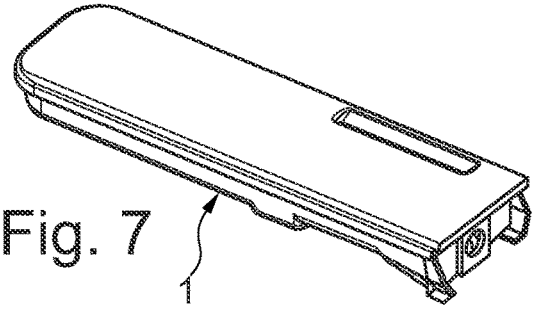
FIGS. 7-11: a plurality of perspective representations of the water tank of a device in accordance with the invention.
Figure 8:
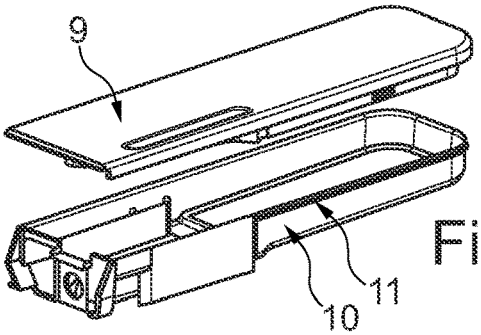
Figure 9:
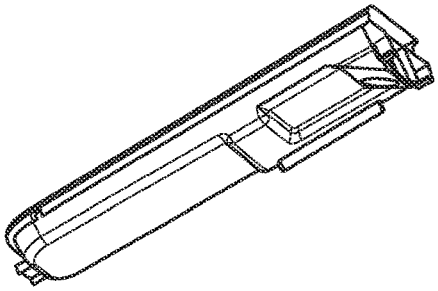

FIGS. 4 and 5 show a side representation and a side sectional representation of a device in accordance with the invention with a water tank 2 in the ejected state;

The sectional representation of FIG. 5 discloses a lever device 4 for raising the water tank 2 from its position cooperating with the piezo unit 7 (cf. FIG. 6). Different spring elements 5, 6 can be used here to hold the water tank in its raised position after triggering the pressing and/or sliding mechanism 1.

FIG. 6 shows an exploded representation of the device in accordance with the invention in which the water tank 2 is shown above a part of the compartment base 3 and the piezo unit 7.

The piezo unit here comprises a piezoelectric element 8 projecting to the water tank and effecting mist generation in cooperation with water present in the water tank. The spring 5 that cooperates with the pressing and/or sliding mechanism 1 at the upper side of the piezo unit 7 and that belongs to the drive mechanism can also be recognized. The lever device 4 that provides a raising of the water tank 2 is likewise spring assisted, as can be recognized with reference to the spring 6.

FIGS. 7-11 show a plurality of perspective representations of the water tank 2, with it being recognized that the water tank 2 has a cover 9 and a base structure 10 coverable thereby. A seal, preferably a rubber seal 11, that provides a watertight seat of the cover on the base structure is provided in the intermediate region of the cover 9 and the base structure 10.

Figure 10:
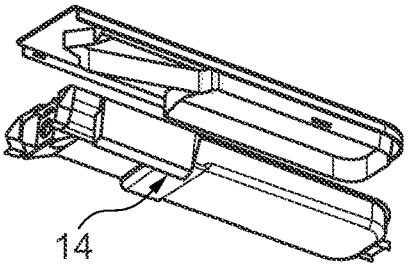
Figure 11:
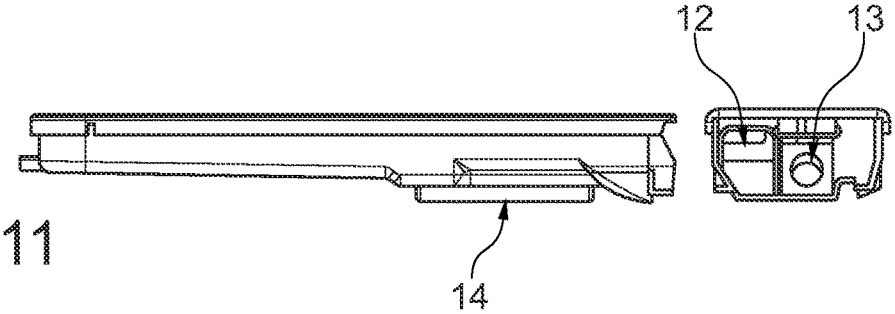

FIGS. 10 and 11 additionally show a mist outlet at the lower side of the water tank. Two openings 12, 13 are provided at the front face of the water tank 2 facing the piezo unit of which the one having the reference numeral 12 serves as a water tank inlet and the other having the reference numeral 13 serves as a recess for inserting the piezoelectric element 8. If the water tank has been introduced flush with the compartment base, these two openings can be sealed so that no water can run out of them.

Figure 12:
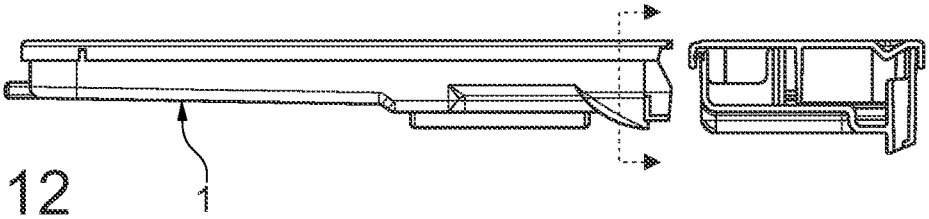
FIGS. 12-13: side and cross-sectional representations of the water tank of a device in accordance with the invention.
Figure 13:
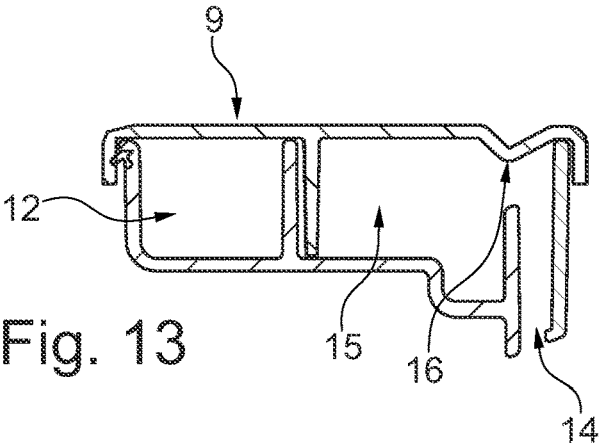

FIGS. 12-13 show a side and cross-sectional representation of the water tank 2 in which the water tank inlet 12 is separated from the vapor generation chamber 15 by a dividing wall extending downward from the cover 9. The mist outlet 14 located in the base region of the water tank 2 and arranged next to the vapor generation chamber 15 can also be recognized. To prevent water located at the inner side of the cover 9 from collecting above the mist outlet and from dropping from there in drop form, a drip edge 16 is provided that provides that water condensing at the cover 9 does not fall in the region of the mist outlet, but rather in the vapor generation chamber 15.

Figure 14:
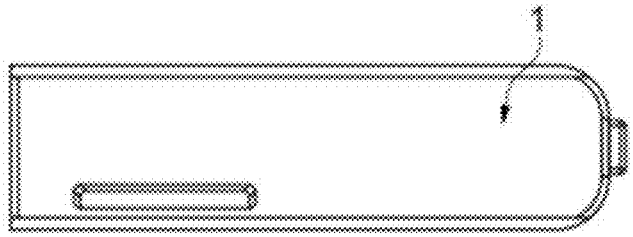
FIGS. 14-16: side and longitudinal sectional representations of the water tank of a device in accordance with the invention.
Figure 15:
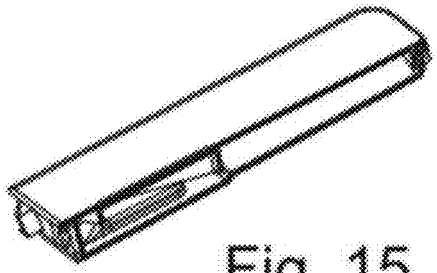
Figure 16:
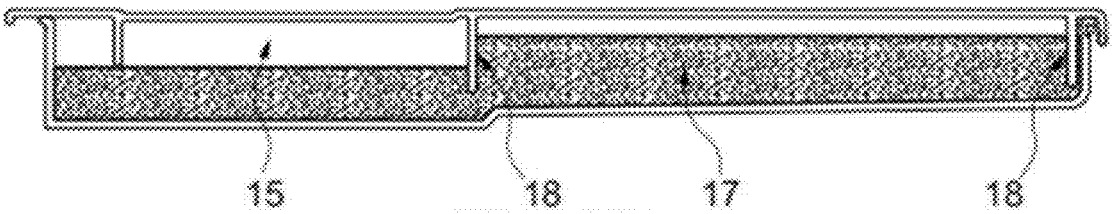

FIGS. 14-16 show side and longitudinal sectional representations of the water tank 2. The water reservoir walls that bound the water reservoir chamber 17 are marked by the reference numeral 18. The vapor generation chamber 15 is separated therefrom by a dividing wall 18 that leads downward from the cover 9 and that enables working with different water levels in the water tank 2.

Figure 17:
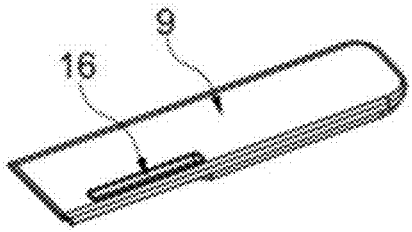
FIGS. 17-18: a plurality of perspective representations of the cover.
Figure 18:
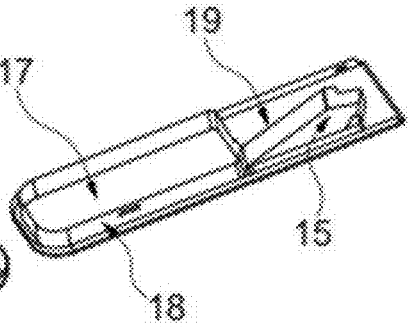
Figure 18:
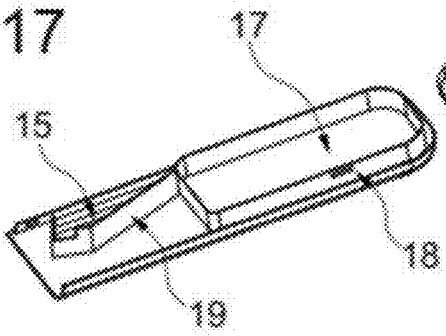

FIGS. 17-18 show a plurality of perspective representations of the cover 9. The negative shape of the drip edge that is effected by a groove-like indentation in the upper side can be recognized at the upper side of the cover 9 in FIG. 17. As already described, this inwardly projecting elevated portion provides that water condensed at the inner side of the cover 9 does not form into drops directly above the mist outlet and then exits the water tank without hindrance. The drip edge provides a falling down of any drops before they are above the mist outlet.

The two representations of FIG. 18 show the lower side of the cover 9. The walls emanating from the cover for forming the water reservoir chamber 17 that is bounded by a reservoir wall 18 can be recognized. The secondary guide wall 19 likewise projecting from the cover guides the mist from the vapor generation chamber 15 to the mist outlet 14.

Figure 19:
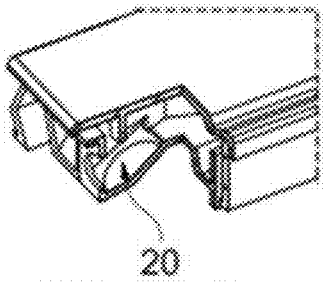
FIG. 19: a partially exposed close-up view of the water tank in the region of a recess shaped for the piezo unit.

FIG. 19 shows a partially exposed close-up view of the water tank 2 in the region of a recess shaped for the piezo unit 7. A wave reflector 20 or a concentrator 20 that deflects the sound waves or a water jet upward to the cover 9 is arranged just behind the recess through which the sound waves generated by the piezoelectric element penetrate into the interior of the water tank. The vapor or mist generated in this process is then guided via the mist guide wall 14 arranged at the cover 9 to the mist outlet so that the mist exits the water tank 2 downwardly.

Figure 20:
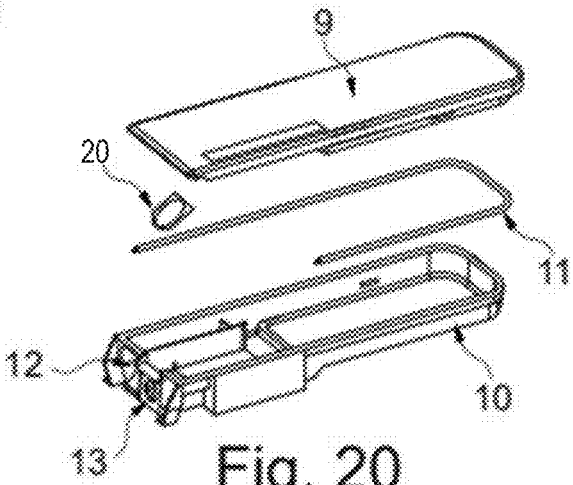
FIG. 20: an exploded view of a water tank used in the invention.

FIG. 20 is an exploded representation of the water tank 2. The cover 9 is here connected by a seal, preferably a rubber seal 11, to the tub-like base structure 10 of the water tank 2 so that no water can exit at the transition to the cover 9. The water inlet 12 and the recess 13 for the passage of the sound waves of the piezo unit 7 can also be easily seen here. The wave reflector 20 or the concentrator 20 can likewise be recognized.

Figure 21:
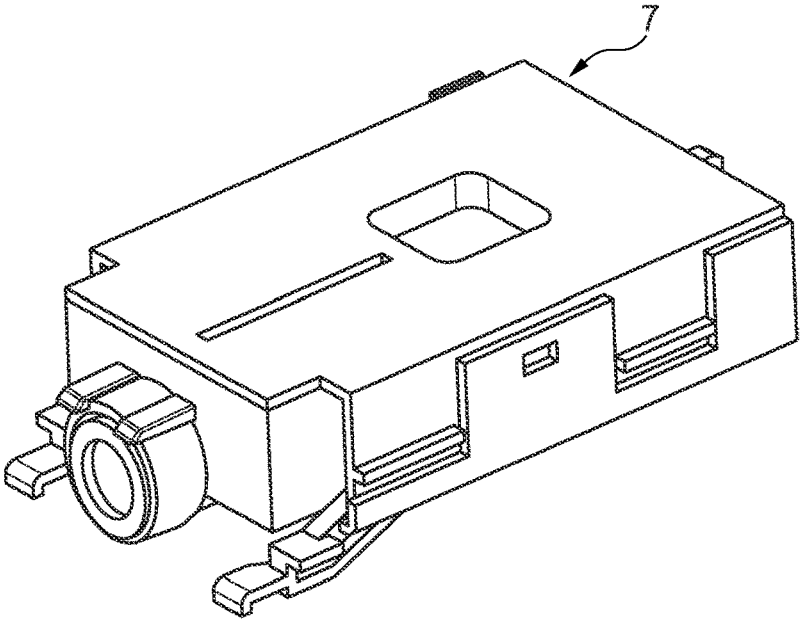
FIG. 21: a perspective representation of the piezo unit of the invention.

FIG. 21 is a perspective representation of the piezo unit 7. The piezoelectric element 8 that is surrounded at both of its sides by the webs of a U-shaped lever device can be recognized in the front face arranged at the left in the drawing. The pressing and/or sliding mechanism that has a trough-like recess for easier operation can be recognized at the upper side of the piezo unit 7. The two webs of the lever device 4 are pivoted upward by a pressing in and/or displacement so that a raising of the water tank 2 occurs.

The piezo unit 7 can, as shown in the Figure, have a box-like shape and have a control circuit 22 for the control of the system in its interior.

Figure 22:
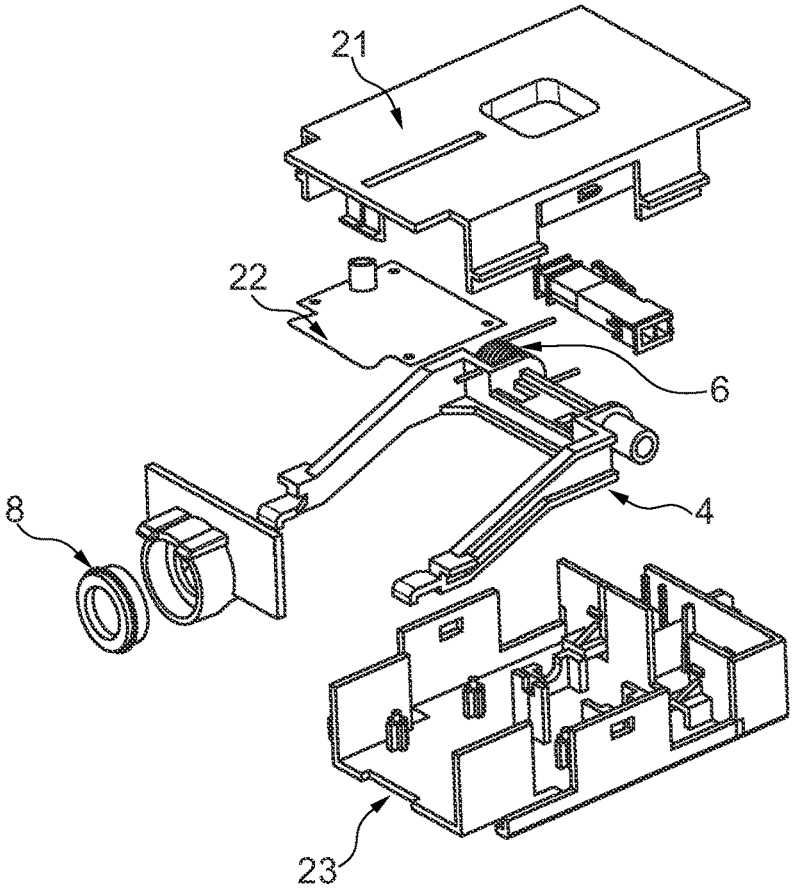
FIG. 22: an exploded representation of a piezo unit in accordance with the invention.

FIG. 22 shows an exploded representation of the piezo unit 7 in which the cover 21 having the sliding mechanism for actuating the lever device 4 and the base structure 23 complementary thereto for forming the box shape can be recognized. The lever 4 that is preloaded by a spring element 6 is clamped therebetween. The control circuit 22 is also received in the interior of the piezo unit 7.

The piezo element 8 that emits the sound waves for the generation of the vapor or of the mist in the water tank is arranged at the front face.

The invention claimed is:

1. A device for mist generation in a refrigerator unit and/or a freezer unit comprising:

a compartment base of a refrigerator for placing goods to be refrigerated in the refrigerator;

a piezo unit that is arranged in the compartment base; and a water tank separate therefrom for mist generation that is operatively connected to the piezo unit that is likewise arranged in the compartment base, wherein the water tank has a cover that is inwardly shaped such that it separates a vapor generation chamber from a water reservoir chamber, wherein the piezo unit is furthermore provided with a mechanism for raising the water tank that works mechanically or with motor assistance, and wherein the piezo unit for raising the water tank has at least one lever device that is configured to actuate via a pressing or sliding mechanism accessible at the surface of the compartment base, with the lever device is provided with at least one spring element.

2. A device in accordance with claim 1, wherein the water tank has a mist outlet to emit mist at the lower side of the compartment base, and wherein the water tank is removable from the compartment base.

3. A device in accordance with claim 2, wherein the cover comprises an inwardly projecting wall at an inner side that shapes different chambers in the water tank.

4. A device in accordance with claim 3, wherein the vapor generation chamber is couplable to a piezoelectric element of the piezo unit via a recess in the outer contour of the water tank to generate mist in the water tank with the aid of the sound waves emitted by the piezoelectric element.

5. A device in accordance with claim 3, wherein the cover has an inwardly projecting drip edge in the transition region of the vapor generation chamber to a mist outlet to prevent water collecting at the cover in the vapor generator chamber from dropping down in the region of the mist outlet, with the mist outlet being an opening in a base region arranged opposite the cover.

6. A device in accordance with claim 4, wherein the water tank is a concentrator that reflects the sound waves or water jets emanating from the piezoelectric element.

7. A device in accordance with claim 1, wherein the water tank terminates with the compartment base in an inserted state such that the compartment base and the water tank form a common approximately planar surface.

8. A device in accordance with claim 4, wherein the piezo unit has the piezoelectric element and the sound waves generated by the piezoelectric element produce a generation of mist in the water tank inserted in the compartment base.

9. A device in accordance with claim 8, wherein the piezoelectric element projects from a front face of the piezo unit such that it can dip into where corresponding recess of the water tank to generate mist there.

10. A device in accordance with claim 1, wherein the piezo unit further comprises all the electronic components that are required to generate the mist.

11. A device in accordance with claim 1, wherein the compartment base is not firmly connected to a carcass of the refrigerator but can rather be pushed into the refrigerator at any desired position.

12. A device in accordance with claim 1, wherein the compartment base is arranged directly above a refrigerator drawer or refrigerator compartment to introduce mist to increase the humidity into the drawer or into the compartment.

13. A device in accordance with claim 1, wherein the water tank and the piezo unit are arranged in the front half of the compartment base.

14. A device for mist generation in a refrigerator unit and/or a freezer unit comprising:

a compartment base of a refrigerator for placing goods to be refrigerated in the refrigerator;

a piezo unit that is arranged in the compartment base; and a water tank separate therefrom for mist generation that is operatively connected to the piezo unit that is likewise arranged in the compartment base, the piezo unit is furthermore provided with a mechanism for raising the water tank that works mechanically or with motor assistance, wherein the piezo unit for raising the water tank has at least one lever device that is configured to actuate via a pressing or sliding mechanism accessible at the surface of the compartment base.

* * * * *